US005954599A

United States Patent [19]

Lin

[11] Patent Number: 5,954,599

[45] Date of Patent: Sep. 21, 1999

[54] AUTOMATED SPORT BOUNDARY OFFICIATING SYSTEM

[75] Inventor: Don L. Lin, Neshanic Station, N.J.

[73] Assignee: Lucent Technologies, Inc., Murray Hill, N.J.

[21] Appl. No.: 09/006,534

[22] Filed: Jan. 13, 1998

[51] Int. Cl.[6] ..... A63B 61/00

[52] U.S. Cl. ..... 473/467; 340/323 R

[58] Field of Search ..... 473/459, 461, 473/463, 467; 340/323 R, 551

[56] References Cited

U.S. PATENT DOCUMENTS

| | | | |
|---|---|---|---|
| 3,415,517 | 12/1968 | Krist | 273/31 |
| 3,982,759 | 9/1976 | Grant | 273/31 |
| 4,092,634 | 5/1978 | Von Kohorn | 340/323 R |
| 4,365,805 | 12/1982 | Levine | 273/31 |
| 4,432,058 | 2/1984 | Supran | 364/410 |
| 4,664,376 | 5/1987 | Gray | 273/29 |
| 4,840,377 | 6/1989 | Bowser et al. | 473/459 |
| 4,855,711 | 8/1989 | Harrop et al. | 340/323 R |
| 4,859,986 | 8/1989 | Van Auken et al. | 340/323 R |
| 4,866,414 | 9/1989 | Diaconu et al. | 340/323 R |
| 5,059,944 | 10/1991 | Carmona | 340/323 R |
| 5,082,263 | 1/1992 | Berger | 273/29 |
| 5,138,322 | 8/1992 | Nuttall | 342/126 |
| 5,303,915 | 4/1994 | Candy | 273/31 |
| 5,342,042 | 8/1994 | Candy et al. | 273/31 |
| 5,394,824 | 3/1995 | Johnson, Jr. | 116/203 |
| 5,489,886 | 2/1996 | Wexler et al. | 340/323 R |

*Primary Examiner*—Kien T. Nguyen
*Attorney, Agent, or Firm*—Synnestvedt & LechnerLLP

[57] ABSTRACT

An automated method and apparatus for determining whether a ball in a sport has contacted the ground in or out of bounds as well as where along the boundary the impact occurred. A pair of conductors run adjacent to and beneath the boundary lines of the sport court or field. The two conductors are electrically separated by an insulator, but will contact each other at the point of impact and thereby create an electrical short when a force, such as is caused by the impact of a ball, is applied to the boundary line. The short causes two counter-propagating voltage pulses to travel out from the location of the short towards a detector which detects the pulses and the time delay between receipt of the pulses. The fact of whether pulses were detected is indicative of whether the ball was in or out of bounds, while the time delay between the pulses is indicative of the location along the boundary line where the ball struck the ground.

28 Claims, 4 Drawing Sheets

AUTOMATED SPORT BOUNDARY OFFICIATING SYSTEM

FIELD OF THE INVENTION

The invention pertains to an automated method and apparatus for determining when a sport ball, such as a tennis ball, lands in or out of play.

BACKGROUND OF THE INVENTION

In the game of tennis, the tennis ball can travel at speeds well in excess of 100 mph. When the ball bounces off the ground on or near a boundary line of the tennis court, it is often difficult to determine with the human eye exactly where the ball struck the ground since it is in contact with the ground only for a split second. Obviously, it is of great importance to the play of the game to make this determination as accurately and as quickly as possible. In a professional tennis match, there can be as many as ten officiators whose primary responsibility is to determine whether the tennis ball bounced in or out of bounds. Due to the difficulty of accomplishing this task using only the naked human eye, dozens of automated systems for determining whether a tennis ball has struck the ground in or out of bounds have been proposed and/or developed.

Many of the systems are electromagnetic in nature and require a specially designed tennis ball having specific electromagnetic materials therein which allow the position of the ball to be detected when it is in the vicinity of a boundary line. The boundary line is equipped with electromagnetic field detecting equipment to detect the position of the ball when it is near the boundary line. Examples of such systems are disclosed in U.S. Pat. Nos. 5,342,042, 5,303,915, 4,859,986, 4,664,376, 4,432,058, and 4,092,634. These types of systems are disadvantageous because they require special balls to be effective. The addition of electromagnetic materials to the ball will change the properties of the ball in a manner relevant to play of the game. It also will increase the cost and complexity of the ball.

Other proposed systems employ optical sensors positioned near the boundary lines. Two such systems are disclosed in U.S. Pat. Nos. 5,059,944 and 4,866,414. These systems are disadvantageous because the optical sensors are very expensive and need to be placed in positions that may interfere with play. Further, the players' bodies may block the optics, causing the system to be unable to detect the ball.

U.S. Pat. No. 5,394,824 discloses a thermo-chromic system in which the boundary lines are coated with a thermochromic material that changes color when it is struck by the tennis ball. The change in color is dependent at least in part on the speed of the ball when it contacts the thermo-chromic material. The change in color remains for a limited period of time after contact and, thus, gives an officiator a finite amount of time to run to the spot and examine the line after a ball strike to determine where on the thermo-chromic line the ball strike occurred. The time required to run to the spot and observe the line adds delay to the game.

U.S. Pat. Nos. 3,982,759 and 4,365,805 disclose systems in which the tennis court boundary lines are outlined with a laminate comprising two conductors separated by an insulating layer. When a ball strikes the laminate, the two conductors will be compressed towards each other, triggering a pressure sensitive switching means, thereby generating a particular electrical signal indicating that the ball has struck the laminate. Depending on whether the laminate is positioned just out of bounds or just in bounds, the generation of the signal will indicate that the ball strike was out of bounds or in bounds, respectively.

U.S. Pat. No. 4,365,805 also discloses a method and apparatus by which the location of the ball strike in the direction parallel to the boundary line also is determined. Particularly, the two parallel conductive strips are separated by an insulating strip with holes therethrough. When the ball strikes the laminate, it will cause the two separated conductive layers to compress towards each other and contact each other in the positions adjacent the holes, but will remain separated by the insulating material in the positions corresponding to where there are no holes. Thus, the holes and the adjacent conductor portions form switches that selectively couple the two conductive layers when pressure is applied to the strip. These switches are all interconnected by a series of thin-film resistors or resistive wires. By connecting the switches with resistors, a switch closure, rather than resulting in a complete electrical short, instead creates an electrical circuit having a unique resistance profile for each switch. By measuring the resistance of the circuit when a switch is closed due to a ball strike, the unique switch which was closed is determinable. Accordingly, this system not only detects whether the ball struck the laminate, but where in the direction parallel to the laminate strip (i.e., parallel to the boundary line) the ball struck.

U.S. Pat. No. 4,855,711 also discloses a pressure sensitive switch type system. However, in this system, two conductive layers are separated by a continuous resilient insulating layer. When the ball strikes the laminate strip, the two parallel separate conductors do not contact each other, but merely move closer to each other due to the compression of the resilient insulating layer. The change in distance between the two conductive layers yields a displacement current in the conductive layers which is detected and indicative of the fact that the ball struck the laminate strip. Processing of the displacement current is performed to distinguish whether the compression was due to spurious impact, e.g., a foot or a racket striking the laminate strip, or a ball strike. The different types of impacts can usually be easily distinguished by the shape and duration of the displacement current. For instance, a footstep on the line typically will cause a compression of much longer duration than a ball strike and thus create a displacement current of much longer duration.

One disadvantage of all of the aforementioned prior art line calling systems is that they are expensive to manufacture, comprising specially made laminates (in the case of the pressure sensitive type systems or electromagnetic systems) or optical equipment (in the case of the optical systems). The systems disclosed in U.S. Pat. No. 4,365,805 is particularly expensive in that the conductors in the laminate include thin film resistors or resistive wires between all of the switches.

Accordingly, it is an object of the present invention to provide an improved, instant sport line calling system.

It is another object of the present invention to provide a low cost sport line calling system.

It is yet another object of the present invention to provide a sport line calling system which can detect a ball impact that occurs contemporaneously with a separate, spurious impact on the boundary.

It is a further object of the present invention to provide a low cost tennis line calling system which determines not only whether a ball has struck the ground in or out of bounds but also where in the direction parallel to the boundary the ball strike occurred.

SUMMARY OF THE INVENTION

The invention is a method and apparatus for determining in an automated fashion whether a sport ball or player has contacted the ground in or out of bounds. The apparatus comprises multiple spring-loaded plates placed end to end along the boundary lines of the playing field. Running beneath the plates is a pair of generally parallel conductors that are normally separated by an insulator, (i.e., electrically isolated form each other) over their entire lengths. Each spring loaded plate carries a conductive probe which, responsive to compression of the plate, such as by a ball impact, temporarily contacts both conductors, causing a momentary short between the two conductors. The probe is part of a mechanical switch arrangement that allows only instantaneous shorting of the two conductors regardless of the duration of the actual impact.

One conductor is coupled to ground and the other conductor is coupled to a fixed voltage other than ground. The two ends of a first one of the conductors are coupled to different terminals of a pulse detecting circuit in a control and display unit. The control and display unit is located where it is easily accessible to an officiator of the sport competition. One of the conductors is electrically coupled to the conductive probes which extend in the direction of the other conductor. When there is no force on the plate, the conductive probes do not contact the other conductor. When a force is applied to the plate, such as due to impact of a plate by a ball, the conductive probe of that plate is pushed into momentary contact with the other conductor, thus closing the open circuit between the two conductors. When the two conductors are momentarily electrically connected by one of the probes, two voltage pulses are generated which propagate in opposite directions from the connection point along the first conductor to the control and display unit which detects the pulses.

The control and display unit further contains circuitry for visibly and/or audibly indicating when voltage pulses are detected.

For the game of tennis, the plates may be located parallel to and adjacent the relevant boundary lines in a tD position such that they are completely in bounds. Accordingly, when the ball appears to strike the ground very close to the boundary line, if voltage pulses are detected, it indicates that the ball struck the ground in bounds. If not, it indicates that the ball was out of bounds.

In a preferred embodiment, the control unit not only detects the pulses, but also analyzes the difference in time between receipt of the two counter-propagating pulses and determines therefrom the location, in the direction parallel to the boundary, that the ball contacted the boundary. The location of the impact is instantaneously displayed on a display unit which shows an outline of the court and indicates the point of impact thereupon. In this manner, it is easy to determine if a pulse was generated by the ball or by a spurious contact with the line, such as by a player's foot. Particularly, the officiator will know the general location of the ball strike and of each of the players from watching the game. Accordingly, an impact indicated near the position of the ball and away from the position of the players was obviously caused by the ball.

Preferably, the two parallel conductors and the insulator are provided by a coaxial cable. Particularly, a coaxial cable is positioned beneath the plates. An electrically conductive probe, attached to the plate, is disposed in the coaxial cable so as to be in permanent contact with the outer conductor of the coaxial cable and to lie adjacent, but not in contact with, the inner conductor. An arm is rigidly attached to the plate and extends into the coaxial cable adjacent the probe. When a ball hits the plate, pushing it and the arm downwards, a shoulder on the arm contacts the probe pushing the probe into momentary contact with the center conductor of the coaxial cable, thus shorting the electrical loop between the outer conductor and the center conductor. The contact is instantaneous regardless of the duration of the compressed condition of the plate. Thus, a foot standing on the plate will not cause the system to dwell in the short condition.

DETAILED DESCRIPTION OF THE INVENTION

Figure 1:
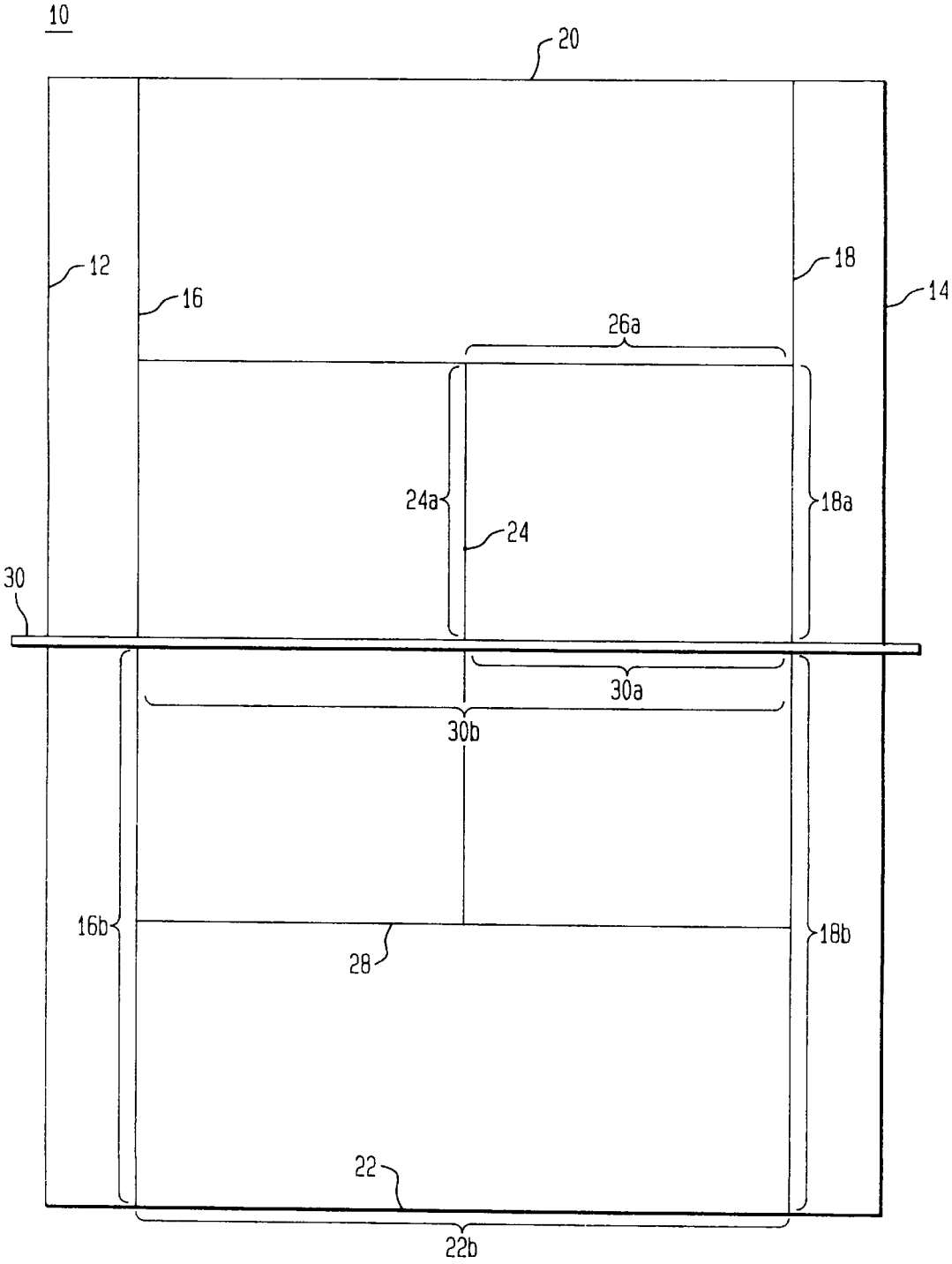
FIG. 1 is a perspective view of a tennis court.

The invention is described herein with respect to an embodiment adapted for the game of tennis. However, it should be understood that the invention can be adapted for any sport that has boundaries. FIG. 1 is a perspective view of a tennis court. However, it should be understood that the invention can be used in any sport having boundaries and a need to determine when something (e.g., a ball or a player) contacts the ground out of bounds. Each of the lines 12 through 28 on a tennis court defines a boundary within which the tennis ball must strike the ground during at least a portion of play in order for the ball to remain in play. For instance, during service, a player standing behind line 22 may be required to serve the ball in such a manner that it clears the net 30 and lands within the box defined by line segments 24*a*, 26*a*, 18*a* and net portion 30*a*. During non-service play in a singles match, when the player playing on the upper side of the court (as shown in FIG. 1) returns the ball, it must clear the net and land within the box defined by line segments 16*b*, 18*b*, and 22*b* and the net portion 30*b*. In each instance, the line itself is in bounds. In order for the ball to be out of bounds, the entire ball must strike the ground outside of the outer edge of the line.

During even amateur play, a tennis ball can reach speeds in excess of 60 mph. In professional play, the ball is frequently moving at speeds in excess of 70 mph and, particularly during service, can move at speeds well in excess of 125 mph. Accordingly, when the ball strikes the ground, it typically is in contact with the ground for an extremely short duration. In play, when the ball contacts the ground on or near a relevant boundary line, it is extremely important to determine exactly where the ball struck the ground so that it can be determined whether the ball was in bounds or out of bounds. However, because the ball is in contact with the ground for a very short period of time and the ball often is moving at speeds more rapid than the human eye can follow accurately, the naked eye frequently can determine the position of the ball at the point of ground contact with no greater an accuracy than within a few inches.

In accordance with the present invention, a series of plates are embedded within the ground adjacent to and just within the outer edge of each boundary line 12 through 28. The plates overlie an electrical conductor system that is adapted to generate counter-propagating electrical pulses when a ball strikes the plate, as described more fully below. The plates preferably are buried immediately beneath the court surface such that they are not visible, but are sufficiently close to the surface that the force of the impact of a ball on the surface immediately above a plate will be transmitted through to the plate. Alternately, the plates can be laid directly on top of the court surface, but, in such an embodiment, should be as level with the court as possible so as not to interfere with play of the game.

Figure 2A:
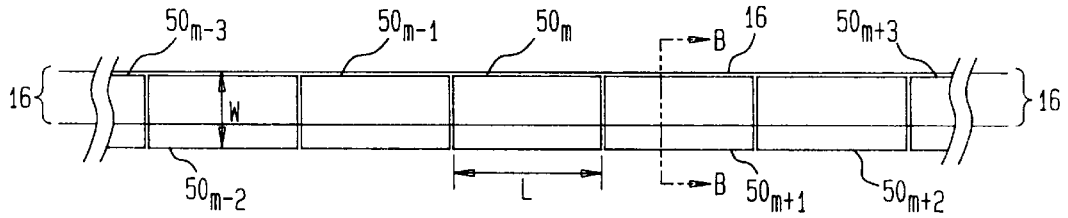
FIG. 2A is a plan view of a portion of a boundary line in accordance with the present invention.
Figure 2B:
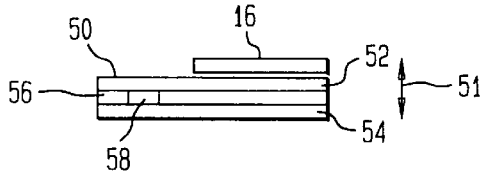
FIG. 2B is a cross-sectional view taken along line B—B of FIG. 2A.
Figure 5:
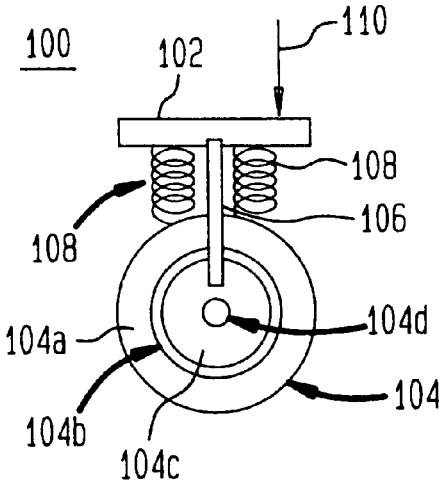
FIG. 5 is a cross-sectional view of a plate portion of the present invention as shown in FIG. 3 in accordance with a first preferred embodiment of the present invention.
Figure 6:
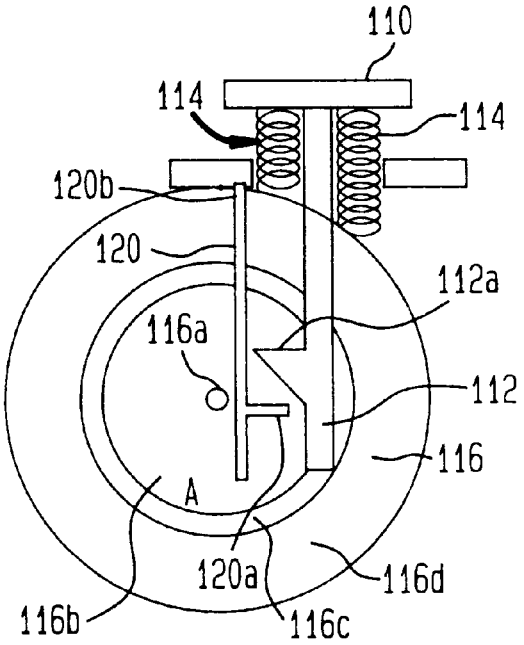
FIG. 6 is a cross-sectional view of a plate portion of the present invention as shown in FIG. 3 in accordance with a second preferred embodiment of the present invention.

The entire boundary lines are outlined by N plates 50 placed end to end along the boundary lines, each of length L and width D. FIG. 2A is a close-up plan view of a segment of boundary line 16 of FIG. 1 illustrating several of the plates 50 of the present invention. FIG. 2B is a cross-sectional view of a plate and the underlying electrical conductor system taken along line B—B of FIG. 2A. Each plate 50 is spring-loaded or otherwise resilient in a direction perpendicular to the ground, as illustrated by arrow 51. Beneath the plates are two conductors 52 and 54 which are normally separated perpendicular to the ground by an insulating layer 56. The insulator may be nothing more than air or a vacuum. Alternately, it may be a solid dielectric material. The plate, conductors and insulator all may comprise a single laminate as illustrated in FIG. 2B. In one type of design, the insulating material has holes therein where the two conductors can contact each other under force perpendicular to the ground. U.S. Pat. No. 4,365,805 discloses an exemplary laminate comprising two conductors separated by an interrupted insulating layer with holes therethrough at regular intervals. Alternately, the plate may be positioned above and in contact with separate conductors and an insulator as illustrated in FIGS. 5 and 6 to be discussed further herein.

Figure 3:
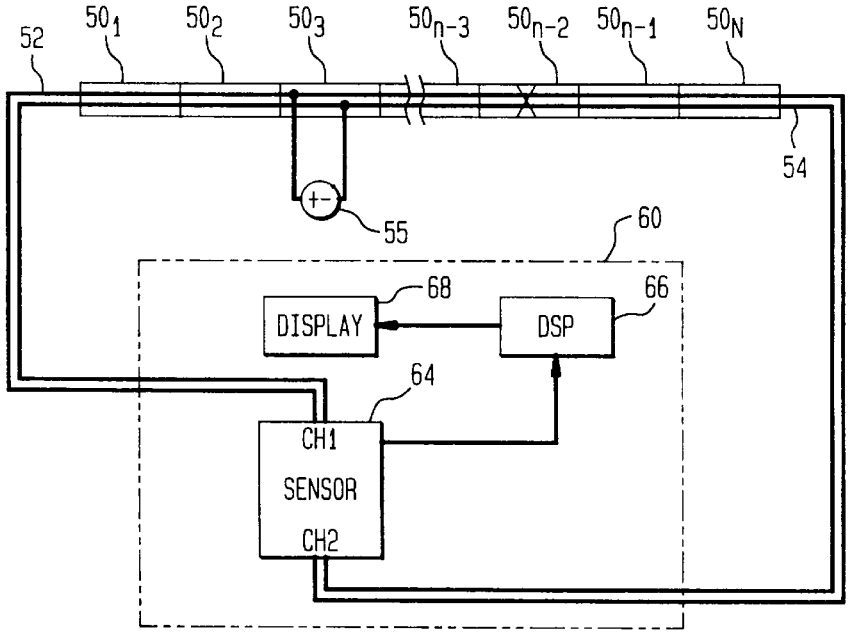
FIG. 3 is a diagram illustrating the components of a tennis line calling system in accordance with the present invention.

FIG. 3 is a block diagram showing the electrical components of the present invention. The two conductors 52 and 54 underlying each plate are electrically coupled in series directly to the conductors of the two immediately adjacent plates. Thus, for example, the conductors 52 and 54 underlying plate $\mathbf{50}_2$ are coupled to the corresponding conductors 52 and 54, respectively, in the immediately preceding plate $\mathbf{50}_1$ and immediately succeeding plate $\mathbf{50}_3$. In fact, as illustrated, in a preferred embodiment of the invention, the conductors 52 and 54 comprise continuous conductors underlying all of the plates $\mathbf{50}_1$ through $\mathbf{50}_N$. Where a discontinuity in physical adjacency of two electrically adjacent plates is necessary (such as may occur at the end of a straight section of boundary line), the conductive paths nevertheless remain continuous.

A voltage potential is impressed across the two conductors 52 and 54, such as by coupling a battery 55 across the two conductors. The conductors extend from the battery parallel to each other and along the entirety of the boundary lines underneath the plates 50. From the first plate $\mathbf{50}_1$, the first and second conductors 52 and 54 are coupled to a first channel terminal of a sensor 64 in the control unit 60. From the last plate $\mathbf{50}_N$, the opposite ends of the first and second conductors 52 and 54 are coupled to a second channel terminal of sensor 64.

When the grounded conductor 54 and the powered conductor 52 contact each other due to the pressure of a tennis ball striking a plate 50, an electrical short is created across the battery 55 at the point of contact. Two counter-propagating voltage pulses will appear at this point and propagate through conductors 52 and 54 in opposite directions from the point of contact to the first and second channels of the sensor 64. Sensor 64 detects the voltage pulses on each of its channels and the time delay therebetween. Control unit 60 preferably includes a digital signal processor 66 for processing the data.

Figure 4:
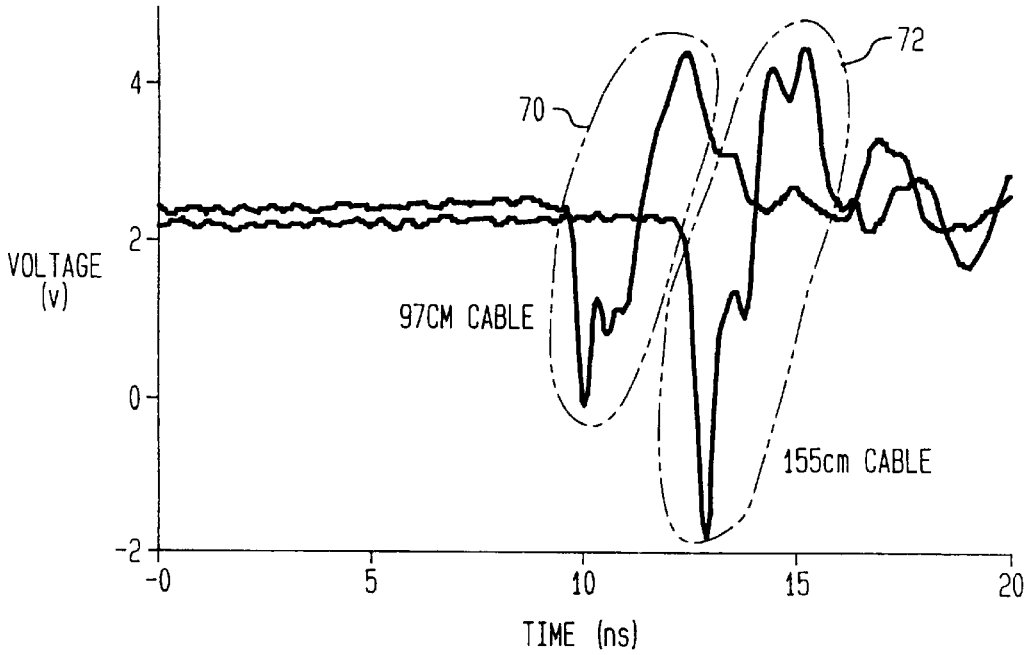
FIG. 4 is a graphical plot of the two detected counter-propagating voltage pulses generated by a ball strike near the boundary line in accordance with the present invention.

FIG. 4 illustrates an exemplary signal received by the sensor 64. There are two voltage pulses 70 and 72 of generally similar shape, but offset in time from each other. The time offset is due to the fact that the pulses travel from the location of the short to the control unit in opposite directions along the conductors and, therefore over paths of different length.

The control unit 60 is positioned near an officiator of the tennis match and includes hardware and any necessary programming, such as exemplified by digital signal processor 66 in FIG. 3, for indicating when voltage pulses are detected. A display unit 68 instantaneously generates a visual display responsive to the detection of voltage pulses.

As described more fully below, the apparatus detects, not only whether a ball struck the ground in bounds, but where along the boundary it struck the ground and displays the location on the display. For instance, the display preferably includes a representation of the court on which the location of the detected short is displayed.

In most sports, a short can be the result of causes other than the event which it is desired to detect. For instance, in tennis, a short may be created by one of the players stepping on a plate. Therefore, it is desirable to know, not only whether the ball struck a plate, but where along the boundary lines the short occurred so that it can be easily distinguished from a nearly simultaneous short caused by a player's foot striking the line at a different location. The point of contact can be determined from the delay between receipt at the control unit of the two counter-propagating pulses. The time delay between the two pulses will be unique for each potential contact point and thus will indicate exactly where the short occurred.

Particularly, let us assume that the overall length of the electrical loop is L and that the distance in one direction from the point where the short occurs to the control unit is $l_1$ and the distance in the other direction from the short circuit point to the sensor is $l_2$. Thus, $l_1+l_2=L$. Let us also assume that the speed of the electrical signals in the conductors is velocity, v. The amount of time between receipt of the counter-propagating voltage pulses, $\Delta t$, is directly indicative of the lengths $l_1$ and $l_2$ and thus, the location of the ball strike. The location is given by $l_1=(L+v\Delta t)/2)$ (equation 1).

The value of v can be determined by creating a short at a known location for which the values of $l_1$ and $l_2$ are known and measuring the time delay $\Delta t$ between receipt of the two pulses at the sensor. L is known simply by measuring the length of the overall circuit path. The value of $\Delta t$ can be measured every time a short circuit condition occurs by sensor 64. The value of $l_1$ is thus easily calculated in accordance with equation 1. It should be understood that there are many well known circuits and/or software routines for detecting and measuring time delay between pulses and that sensor 64 is merely one representative means.

The two counter-propagating pulses corresponding to one impact with the line are easily distinguishable in the control unit from two counter-propagating pulses corresponding to a different, but near simultaneous, impact with the line because the velocity of the pulses is so great. The speed of the electric current in a typical conductor is approximately ⅔ the speed of light. Thus, the time delay between counter-propagating pulses corresponding to one impact will be received by the sensor within a time period on the order of 5–10 nanoseconds. The likelihood of two separate line impacts occurring within such a short time of each other are diminishingly small.

A more likely scenario is the occurrence of a second short during the duration of a first short at a different location. In such a situation, it is believed that the second short still will generate counter-propagating voltage pulses, but of a much smaller relative magnitude than if the line was not already short circuited in a different location. This will occur because, in a practical implementation, the conductor will not be a perfect conductor, but will have a very small resistance. Accordingly, the pulses caused by the second short may be of sufficient magnitude to be detectable. In this type of situation, the display unit will display impacts at two different locations. The officiator can easily determine which one was caused by the ball and which one was caused by the player by simply comparing the indicated impact points with his own visual perception of the relative positions of the ball and the player.

The sensor 64 in the control unit 60 should, therefore, be designed, not only to detect the pulses, but also the delay therebetween. Various circuits and/or software routines that can accomplish this task will be readily apparent to persons of ordinary skill in the related arts. The control unit should further include software or hardware to calculate the length $l_1$ using equation 1 and convert that length into a position along the boundaries of the tennis court. Further, the display unit 68 should display the determined location with an "X" or similar indication displayed on an outline of the court appearing on the display screen.

The display may comprise, for instance, a CRT screen showing an outline of all the boundaries (e.g., such as shown in FIG. 1). The point where the ball strike occurred can be indicated by an "X" or a change in color of the boundary where the short occurred.

In this manner, the officiator can easily determine whether the short was created by the ball or some other spurious cause. This is so because the officiator can tell with his eyes the approximate location of the ball strike as well as the approximate location of the players. When one of the shorts is displayed as being at a location on the court close to where the officiator's eyes perceived the ball strike and distant from where the officiator's eyes perceived each of the players, then he will know that it was that particular short which was created by the ball rather than the player.

In a preferred embodiment, when a short circuit occurs, the display unit displays it for a short period of time after the short circuit is completed. As previously noted, the ball is in contact with the ground for a fraction of a second. Since the officiator normally will be watching the game and not the display screen, it is preferable that the display screen maintain the indication of a ball strike for a finite period, e.g., ten seconds after the actual short circuit is completed. Alternately, the location of the last short can be displayed continuously until the next short is detected or until the officiator manually clears the screen.

In a preferred embodiment of the invention, the control unit has sufficient memory and programming to store and replay a finite time period of past play. It also preferably time stamps the data in an appropriate manner. This will allow an officiator to go back and consult the data if it is necessary to do so at a later time, such as, after the end of a point or even after the end of an entire match. Thus, an even further option would be to allow the officiator to depress a button which will cause the display to show all shorts that occurred within a finite period of time prior to the depression of the button, e.g., ten seconds. This will allow the officiator to depress the button immediately after a close call and review the preserved data as soon as convenient after the occurrence of the close call.

In tennis, if any portion of the ball strikes the line, then the ball is considered in bounds. A tennis ball can deform substantially when it strikes the ground. The ball also may skid against the ground. In each of these instances, if any part of the ball contacted the line, the ball is considered in bounds. Thus, in tennis, it is preferable to place the plates with one edge collinear with the outside edge of the boundary line and extending (in its width dimension) in bounds, as shown in FIG. 2A. In this manner, if any portion of the ball strikes the ground in bounds, a short circuit will be created indicating that the ball was in bounds. Otherwise, if no portion of the ball is in bounds, no short circuit will be detected.

It should be understood that, for other sports in which the boundary rules differ, the plates may need to be placed in a different orientation relative to the boundary line to achieve the necessary function. For instance, in football, it is frequently necessary to determine whether a player's foot was out of bounds. In football, if any part of the player's foot is outside of the outer edge of the boundary line, he is out of bounds. Thus, in football, the best placement of the plates relative to the boundary line would be with their inner edges collinear with the outer edge of the boundary line and with their width dimensions extending outwardly from the line further into the out of bounds. In this embodiment, detection of a short indicates the opposite than in the above-described tennis embodiment, i.e., a short indicates an out of bounds condition, rather than an in bounds condition.

Thus, in operation, the tennis match officiator observes the game in the normal fashion without the aid of the automated line calling system. When the ball strikes sufficiently close to a relevant boundary line that the officiator is not certain whether the ball struck the ground in or out of bounds, he may glance down at the display screen of the control unit to determine whether the ball was in bounds or out of bounds. Particularly, if the ball was visually close to a boundary line and the display screen does not indicate the detection of a short circuit, the ball must not have struck a plate and, therefore, must have landed out of bounds. On the other hand, if the display indicates that a short circuit was detected near the location where he visually perceived the ball strike, the ball was in bounds.

The width W of the plates should be selected to be as wide as the distance within which the naked eye could reasonably make an error in judgment. For instance, even with ball speeds as high as 140 mph, the naked eye can tell whether a ball was in bounds or out of bounds when it strikes the ground more than two inches away from the boundary line. If the ball lands within 1–2 inches of the line, judgment can be difficult. Accordingly, the width of the plates should be at least 2 inches wide and preferably about 2–3 inches wide.

Since, in the embodiments described to this point, an out of bounds ball is indicated by the lack of a display signal, a potential problem arises when the system is not operating. Particularly, if an officiator see a ball bounce near the boundary line and the display system does not indicate a strike on one of the plates, the officiator should interpret that as indicating that the ball was out of bounds. However, it is possible that the system simply is not functioning properly. In order to solve this problem, it may be advisable to provide a second series of plates and associated conductors and other equipment positioned just outside of the boundary line. Accordingly, in this embodiment, when a ball strikes close to the boundary line but out of bounds, a strike will be indicated by the secondary system indicating that it was out of bounds. The display indicator corresponding to each of the two plate systems should be differentiated from each other, such as by having the in bounds plate system generate a green "X", while the out of bounds system generates a red "X". If, a ball strikes near the line and neither system detects it, the officiator will know that the system is not operating. In this embodiment, a ball may partially strike both sets of plates, since a ball that strikes right on the outer edge of the boundary line will strike the ground partially in bounds and partially out of bounds thus setting off an indication on the display unit by both systems. As previously mentioned, in tennis, if any part of the ball strikes in bounds, the ball is considered in bounds. Accordingly, if both systems detect a strike, then the ball is considered in bounds.

In the preferred embodiment, both sets of plates and associated conductors use as much of the same control unit circuitry as possible in order to avoid to as great extent as possible a situation where the ball does partially strike in bounds, and only the out of bounds system displays a strike because the out of bounds system is operating while the in bound plate system is not operating.

In practice, the exact placement and width of the plates can be determined by a governing body of the particular sport.

FIG. 5 is a cross sectional diagram of a first preferred embodiment of a plate in accordance with the present invention. Particularly, a plate 102 is positioned beneath the court as previously described. The plate may be constructed of a plastic material. A coaxial cable 104 is positioned directly beneath the plate 102. The coaxial cable comprises two conductors 104*b* and 104*d*. Conductor 104*d* is positioned centrally in the cable 104. Outer conductor 104*b* has an annular cross section circumscribing and coaxial with inner conductor 104*d*. An insulating layer 104*c* is sandwiched between the two conductors 104*b* and 104*d*. Further, outer conductor 104*b* is further surrounded by a second annular insulating sheath 104*a*.

A conductive probe 106 is rigidly attached to, and protrudes downwardly from, the bottom of plate 102. The probe 106 protrudes through the outer insulating layer 104a, the outer conducting layer 104*b* and part of the inner insulating layer 104*c* of the coaxial cable. The probe is in permanent contact with the outer conductor 104*b*.

The plate is mechanically coupled to coaxial cable 104 by springs 108. When there is no pressure on the plate 108 and the springs 108 are in their fully extended position, the probe 106 extends partially through inner insulating layer 104*c*, but does not contact inner conductor 104*d*. When downward pressure 110 is applied to the plate 108, such as from a ball striking the plate, springs 108 compress and pin 106 extends further through the coaxial cable and contacts inner conductor 104*d*. This creates a short between outer conductor 104*b* and inner conductor 104*d*. As in the previously described embodiment, outer conductor 104*b* is coupled to a voltage source while inner conductor 104*d* is coupled to ground. In the absence of the probe contacting inner conductor 104*d*, the two conductors are not otherwise connected. When the plate is compressed by a ball strike (or other event), the probe 106 contacts the inner conductor and a voltage pulse is created which propagates in opposite directions through the two conductors towards the control unit. Those pulses are detected by the sensor 64 at the control unit 60 as previously described.

FIG. 6 shows a second preferred embodiment of the present invention utilizing a coaxial cable. As will become clear, this embodiment is preferred to the embodiment of FIG. 5 because, in this embodiment, all electrical shorts are of very brief duration regardless of the duration of the force applied to the plate that caused the short.

In the embodiment of FIG. 6, many components are similar to those illustrated in FIG. 5. A coaxial cable 116 comprises center conductor 116*a* circumscribed by insulating layer 116*b*, an outer conductor layer 116*c* and outer insulating sheath 116*d*. Conductive probe 120 pierces through the coaxial cable and is in permanent electrical contact with the outer conductor 116*c*. Like the FIG. 5 embodiment, when no force is applied to the plate, the probe 120 is positioned adjacent to, but not in electrical contact with, the inner conductor 116*a*. In this embodiment, however, probe 120 is not coupled to the plate nor is it designed to move downwards. Rather, it is hinged at point 120*b* and pivotable about hinge 120*b* as described below. Plate 110 and springs 114 are similar to plate 102 and springs 108 in FIG. 5. Unlike the FIG. 5 embodiment, arm 112 is rigidly fixed to and extends downwardly from plate 110. Arm 112 has a shoulder 112*a* extending in the direction of probe 120. Probe 120 has a member 120*a* extending in the direction of arm 112.

When plate 112 is urged downward by an impact, shoulder 112*a* engages member 120*a* and urges pin 120 to rotate towards and into contact with center conductor 116*a*. The contact is only momentary because once shoulder 112*a*, on its downward motion, clears member 120*a*, probe 120*a* will return to the position shown in FIG. 6. In this manner, for any ball strike, footstep or other force on the plate, a short circuit of only an extremely duration will be created.

When the force on plate 110 is released, arm 112 rises up again due to the action of springs 114 and shoulder 112*a* again contacts member 120*a*. Member 120*a*, however, is hinged such that it bends upwardly and allows shoulder 112*a* to clear the member 120*a* without pushing the probe back towards the conductor. Accordingly, when the force on the plate is released, it does not create another electrical short.

In this embodiment, therefore, the potential problem of a second short occurring contemporaneously with the duration of a first short (and the attendant potential difficulty in detecting the second short) is eliminated because the short conditions are of such short duration that the chance of contemporaneous shorting at two or more positions becomes diminishingly small. Specifically, every short will last only for an extremely short period (on the order of less than a millisecond), rather than for the entire duration of the force on the plate. Thus, the chances of two electrical shorts existing concurrently are extremely small.

The optimal distance between adjacent locations of potential electrical shorts (e.g., the probes of FIGS. 5 and 6) will be a function of the particular sport. It also will be a function of the length and mechanical properties of the plate. Specifically, the probes should be close enough to each other relative to the length and mechanical properties of the plates, the size of the ball, and the range of forces with which the ball may strike the plates that a ball strike anywhere on a plate will cause at least one pin (and preferably only one pin) to create a short.

The length of each plate may be any reasonable length. The optimal length also will be a function of the particular sport. An entire boundary line may be comprised of one continuous plate with multiple probes along its length. However, it is preferable that the plates actually be discrete and of relatively short length (e.g., less than 6 inches) and comprise a single probe each in order to better mechanically isolate the short circuit contact points from each other. Particularly, the force of a ball striking a plate will tend to to be spread through the entire length of the plate. This might cause multiple pins to cause a short circuit, thus making it more difficult to pinpoint the location of the strike. Accordingly, in a preferred embodiment of the invention, each plate has a single probe and is of a relatively short length, e.g., less than 6 inches. The coaxial cable 104, on the other hand, may be a single continuous cable running beneath the N plates.

If a discontinuity must exist between physical adjacency of one plate and its electrically adjacent plate, the coaxial cable itself may remain continuous. The cable portion coupling the such a plate M to the next plate in the series electrical loop could simply be comprised of the same coaxial cable without holes or probes extending therethrough.

The embodiments utilizing a coaxial cable as illustrated in FIGS. 5 and 6 are particularly advantageous because of its inexpensive but rugged construction. Particularly, coaxial cable is readily available, relatively inexpensive, and very reliable and rugged. Further, the entire electrical circuit (other than the control unit) may be constructed of one continuous section of coaxial cable, including the portions of the electrical loop that are merely connections between electrically adjacent, but physically separated plates. Thus, the structure can be inexpensively produced from readily available materials.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

I claim:

1. An apparatus for automatically determining the location at which an object strikes the ground relative to a boundary comprising:

a coaxial cable having a longitudinal axis adapted to be positioned along said boundary and comprising an outer conductor surrounding an insulator that further surrounds a central conductor;

a conductive probe extending into said coaxial cable so as to pass through and contact said outer conductor and lie adjacent said central conductor;

said probe positioned such that, when a force is applied in a direction perpendicular to said ground in the vicinity of said boundary, said probe is forced into contact with said central conductor and creates an electrical short between said first and second conductors; and a voltage detector coupled to said coaxial cable to detect said electrical short.

2. An apparatus as set forth in claim 1 wherein said outer conductor is coupled to a first voltage level and said central conductor is coupled to a second voltage level different from said first voltage level and, in the absence of a short, said outer conductor and said inner conductor are electrically isolated from each other, whereby a short causes first and second counter-propagating voltage pulses to be generated at said short.

3. An apparatus as set forth in claim 2 further comprising a timer circuit for measuring the time delay between receipt of said first and second voltage pulses.

4. An apparatus as set forth in claim 3 further comprising:

a processor for converting said time delay into a location along said boundary; and a display unit for displaying said location.

5. An apparatus for automatically determining the location at which an object struck the ground relative to a boundary comprising:

a plate adapted to be positioned adjacent said boundary, said plate being resilient so as to move in response to a force applied to said plate and to return to a rest position in the absence of said force;

first and second conductors disposed beneath said plate;

means for allowing said first and second conductors to electrically contact each other when a force is applied to said plate so as to create an electrical short between said first and second conductors, whereby first and second counter-propagating voltage pulses are created; and a voltage detector coupled to said first and second conductors for detecting said first and second voltage pulses and determining a time delay between receipt thereof.

6. An apparatus as set forth in claim 5 wherein said first conductor is coupled to a first voltage level and said second conductor is coupled to a second voltage level different from said first voltage level and, in the absence of a short, said first conductor and said second conductor are physically separated from each other, whereby a short causes said first and second counter-propagating voltage pulses to be generated at said short.

7. An apparatus as set forth in claim 6 further comprising a circuit for calculating the location where said short occurred responsive to said time delay.

8. An apparatus as set forth in claim 7 wherein said voltage detector is electrically coupled to first and second ends of said first conductor and wherein said circuit calculates said location by;

$$l_1=(L+v\Delta t)/2)$$

where $l_1$ is representative of the location of said short;

L is the length of said first conductor from said first end to said second end;

v is the velocity of said voltage pulses in said first and second conductors; and $\Delta t$ is said time delay.

9. An apparatus as set forth in claim 8 further comprising a display unit for displaying said location.

10. An apparatus as set forth in claim 5 wherein said plate comprises N plates mechanically isolated from each other and positioned above and mechanically coupled to said conductors such that movement of said plates is transmitted therethrough to said conductors to create said electrical short.

11. An apparatus as set forth in claim 10 wherein said means for allowing electrical contact is adapted to allow contact between said first and second conductors only at a discrete location and wherein there is a one to one correspondence between plates and said discrete locations.

12. An apparatus as set forth in claim 11 wherein each of said N plates is not more than 6 inches in length.

13. A method for automatically determining the location at which an object struck the ground relative to a boundary, said method comprising the steps of:

placing a plate adjacent said boundary, said plate being resilient so as to move in response to a force applied to said plate and to return to a rest position in the absence of said force;

placing first and second conductors beneath said plate;

placing a conductive probe so as to cause said probe to electrically short said first and second conductors to each other when a force is applied to said plate, whereby first and second counter-propagating voltage pulses are created in said first and second conductors;

detecting said first and second pulses at a known location electrically connected to said conductors; and determining a time delay between receipt of said first and second pulses, whereby a location of said electrical short along said boundary is determined.

14. A method as set forth in claim 13 wherein said detecting step comprises the steps of:

electrically coupling said first conductor to a first voltage; and electrically coupling said second conductor to a second voltage different than said first voltage;

whereby a short causes said first and second counter-propagating voltage pulses to be generated at said short.

15. A method as set forth in claim 14 further comprising the step of:

calculating, responsive to said time delay, the location on said boundary where said short occurred.

16. A method as set forth in claim 15 wherein said first conductor has a first end and a second end and said calculating step comprises the step of:

calculating $$l_1=(L+v\Delta t)/2)$$

where, $l_1$ is representative of the location of said short;

L is the length of said first conductor from said first end to said second end;

v is the velocity of said voltage pulses in said first and second conductors; and Δt is the detected time delay between said first and second voltage pulses.

17. A method as set forth in claim 16 further comprising the step of:

displaying said location relative to said boundary on a display device.

18. An apparatus for automatically determining a location at which an object struck the ground relative to a boundary comprising:

first and second electrical conductors adapted to be positioned adjacent said boundary;

N plates positioned above said first and second conductors and adjacent said boundary line, where N is a positive integer;

means to allow said first and second conductors to contact each other when a force is applied to one of said plates so as to create an electrical short between said first and second conductors, whereby first and second counter-propagating voltage pulses are created; and a voltage detector coupled to said first conductor for detecting said first and second voltage pulses and determining a time delay between receipt of said first and second voltage pulses, whereby a location of said electrical short is determined.

19. An apparatus as set forth in claim 18 wherein:

said first conductor is coupled to a first voltage and said second conductor is coupled to a second voltage different from said first voltage; and a first end of said first conductor is electrically coupled to a first terminal of said voltage detector and a second end of said first conductor is coupled to a second terminal of said voltage detector.

20. An apparatus as set forth in claim 19 wherein said first and second conductors are adapted to allow contact between said first and second conductors at discrete locations and wherein there is a one to one correspondence between plates and said discrete locations.

21. An apparatus as set forth in claim 20 wherein each of said N plates is less than 6 inches in length.

22. An apparatus for automatically determining the location at which an object strikes the ground relative to a boundary comprising:

a plate adapted to be positioned adjacent said boundary;

first and second conductors positioned adjacent said conductors;

a conductive probe in permanent contact with said first conductor and adjacent said second conductor;

an arm fixed to said plate and extending towards said probe, said arm positioned to contact said probe and force it into contact with said second conductor responsive to movement of said plate resulting from a force applied to said plate, whereby an electrical short between said first and second conductors is created causing first and second counter-propagating voltage pulses in said conductors.

23. An apparatus as set forth in claim 22 further comprising:

a member on said probe; and a shoulder on said arm shaped and positioned to engage said member such that, responsive to said force on said plate, said shoulder moves into engagement with said member and forces said probe into contact with said second conductor.

24. An apparatus as set forth in claim 23 wherein said shoulder is shaped and positioned to engage said member only momentarily as it moves responsive to said force applied to said plate.

25. An apparatus as set forth in claim 24 wherein said member is normally in a rest position and is pivotable in one direction from said rest position such that, responsive to engagement with said shoulder as said shoulder moves responsive to a release of said force on said plate said member pivots to allow said shoulder to clear said member without forcing said probe into contact with said center conductor.

26. An apparatus as set forth in claim 25 wherein said pivotable member is spring-loaded so as to return to said rest position in the absence of force.

27. An apparatus as set forth in claim 22 wherein said first and second conductors are comprised of a coaxial cable.

28. A method for automatically determining the location at which an object struck the ground relative to a boundary, wherein said boundary is adjacent a plate and first and second conductors disposed beneath said plate, said plate being resilient so as to move in response to a force applied to said plate and to return to a rest position in the absence of said force, said plate further comprising a conductive probe positioned such that said probe electrically shorts said first and second conductors to each other when a force is applied to said plate, whereby first and second counter-propagating voltage pulses are created, said method comprising the steps of:

detecting said first and second pulses at a known location electrically connected to said conductors; and determining a time delay between receipt of said first and second pulses, whereby a location of said electrical short along said boundary is determined.

* * * * *